US009617985B2

(12) United States Patent
Park

(10) Patent No.: US 9,617,985 B2
(45) Date of Patent: Apr. 11, 2017

(54) HERMETIC RECIPROCATING COMPRESSOR

(71) Applicant: Samsung Electronics Co., Ltd., Suwon-si, Gyeonggi-do (KR)

(72) Inventor: Seong Jun Park, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 467 days.

(21) Appl. No.: 13/869,497

(22) Filed: Apr. 24, 2013

(65) Prior Publication Data

US 2013/0287603 A1 Oct. 31, 2013

(30) Foreign Application Priority Data

Apr. 25, 2012 (KR) ..... 10-2012-0042967

(51) Int. Cl.
*F04B 17/03* (2006.01)
*F04B 39/02* (2006.01)
*F04B 39/14* (2006.01)

(52) U.S. Cl.
CPC ..... *F04B 17/03* (2013.01); *F04B 39/023* (2013.01); *F04B 39/0246* (2013.01); *F04B 39/0261* (2013.01); *F04B 39/0284* (2013.01); *F04B 39/14* (2013.01)

(58) Field of Classification Search
USPC ..... 184/6.5, 6.6, 6.8, 6.28, 6.18
See application file for complete search history.

(56) References Cited

U.S. PATENT DOCUMENTS

| | | | | |
|---|---|---|---|---|
| 3,790,311 | A | 2/1974 | Butts et al. | |
| 8,210,832 | B2 * | 7/2012 | Katayama et al. | 417/415 |
| 2007/0081908 | A1 * | 4/2007 | Nishihara | F04B 39/0246 417/415 |
| 2012/0171065 | A1 * | 7/2012 | Lee et al. | 418/66 |

FOREIGN PATENT DOCUMENTS

| | | |
|---|---|---|
| CN | 1878960 | 12/2006 |
| EP | 0728946 | 8/1996 |
| GB | 1068908 | 5/1967 |
| KR | 10-0229669 | 8/1999 |
| WO | 2005/047699 | 5/2005 |

OTHER PUBLICATIONS

Extended European Search Report dated Jun. 28, 2013, from European Patent Application 13164316.5 (seven pages).
Chinese Office Action dated Jan. 4, 2017 from Chinese Patent Application No. 201310148328.3, 17 pages.

* cited by examiner

*Primary Examiner* — Charles Freay
*Assistant Examiner* — Thomas Cash
(74) *Attorney, Agent, or Firm* — Staas & Halsey LLP

(57) ABSTRACT

A compressor having a simplified structure includes a rotation shaft having a spiral groove formed in an outer circumferential surface of the rotation shaft, and a cap member that accommodates a lower portion of the rotation shaft so that the rotation shaft can rotate in the cap member. The cap member may be fixed to one of a stator and a frame such that the cap member does not rotate together with the rotation shaft. Through the simplified structure, oil stored in a sealing case can ascend, and noise caused by rotation of the rotation shaft can be reduced.

21 Claims, 6 Drawing Sheets

HERMETIC RECIPROCATING COMPRESSOR

CROSS-REFERENCE TO RELATED APPLICATIONS

This application claims the priority benefit of Korean Patent Application No. 10-2012-0042967, filed on Apr. 25, 2012 in the Korean Intellectual Property Office, the disclosure of which is incorporated herein by reference.

BACKGROUND

1. Field

Embodiments disclosed herein relate to an oil supply structure of a hermetic reciprocating compressor in which a compression mechanism for compressing a refrigerant by a reciprocating motion of a piston and an electric motor-operated mechanism for generating a driving force are formed as one body and are accommodated in a sealing case.

2. Description of the Related Art

In general, a compressor, as an element of a refrigerating cycle device, for example a refrigerator, air conditioner, or a heat pump, is a device that compresses a refrigerant at a high temperature under a high pressure. The compressor may be classified into various types of compressors according to a compression method and a sealing structure. Among these, a hermetic reciprocating compressor refers to a compressor that includes a compression mechanism for compressing a refrigerant by a reciprocating motion of a piston and an electric motor-operated mechanism for driving the compression mechanism and in which the compression mechanism and the electric motor-operated mechanism are installed in one sealing case.

Such a hermetic reciprocating compressor includes a rotation shaft for transferring a driving force of the electric motor-operated mechanism to the compression mechanism. Oil for lubricating and cooling elements of each mechanism may be stored in a lower portion of the sealing case, and an oil supply structure may be disposed on the rotation shaft and allow the oil to ascend so as to supply the oil to each element.

As an example of the compressor, a hermetic compressor is disclosed in Korean Patent Laid-open Publication No. 10-2005-0052011. According to the disclosure, an internal path that allows oil to ascend is formed in a lower portion of a rotation shaft, and a spiral groove is formed in an outer circumferential surface of an upper portion of the rotation shaft and connected to the internal path. Also, spiral wings and a guide cap are disposed on the lower portion of the rotation shaft of the compressor and guide the oil stored in a sealing case to the internal path.

Through the structure, the oil stored in a lower portion of the sealing case is picked up by the spiral wings and the guide cap and ascends by passing through the internal path formed in the lower portion of the rotation shaft and the spiral groove formed in the outer circumferential surface of the upper portion of the rotation shaft successively.

However, since the rotation shaft of the compressor disclosed in the above publication requires processing of the internal path, the spiral groove formed outside the rotation shaft, and a communication hole through which the internal path and the spiral groove communicate, processing of the rotation shaft is complicated. In addition, since the guide cap formed in the lower portion of the rotation shaft rotates together with the rotation shaft, this causes vibration of an oil level and associated noise results from the vibration.

SUMMARY

Therefore, it is an aspect of the present invention to provide a compressor having an oil supply structure that allows oil stored in a lower portion of a sealing case to ascend, whereby processing of a rotation shaft is simplified.

It is another aspect of the present invention to provide a compressor having an oil supply structure in which vibration of an oil level caused by rotation of a rotation shaft is prevented and the occurrence of noise is reduced.

Additional aspects of the invention will be set forth in part in the description which follows and, in part, will be apparent from the description, or may be learned by practice of the invention.

In accordance with one aspect of the present invention, there is provided a compressor including: a sealing case having a lower portion in which oil may be stored; a frame accommodated in the sealing case; a compression mechanism including a cylinder fixed to the frame and a piston that advances and retreats so as to compress a refrigerant of the cylinder; an electric motor-operated mechanism including a stator fixed to the frame and a rotor that rotates in the stator; a rotation shaft that is coupled to an inner side of the rotor and rotates together with the rotor, wherein a pickup portion is disposed in a lower portion of the rotation shaft so that at least one part of the pickup portion is submerged in the oil stored in the sealing case and a spiral groove is formed in an upper outer circumferential surface of the pickup portion so as to allow the oil to ascend; and a cap member that accommodates the pickup portion so as to guide the oil stored in the lower portion of the sealing case to the spiral groove together with the rotating pickup portion and that is fixed to one of the frame and the stator.

The cap member may include an accommodation portion having an internal space, of which a top surface is open, so as to accommodate the pickup portion, and at least one leg portion that extends from the accommodation portion in a radial direction and is coupled to one of the frame and the stator.

The accommodation portion may include a lower wall, and sidewalls that extend from the lower wall upward so as to form the internal space.

An opening through which the oil flows into the internal space may be formed in the lower wall.

Vibration of an oil level caused by rotation of the rotation shaft may be prevented by the sidewalls of the cap member and may not be transferred to an outer side of the cap member.

The at least one leg portion may include an extension portion that extends from the accommodation portion in the radial direction, and a hook portion that extends from an end of the extension portion upward and a hanging protrusion that extends from the hook portion, and a coupling protrusion corresponding to the hanging protrusion may be formed on one of the frame and the stator.

The at least one leg portion may be modifiable in such a way that an angle between the hook portion and the extension portion increases when the hanging protrusion is coupled to the coupling protrusion, and the at least one leg portion may be formed of an elastic material in such a way that the at least one leg portion is firmly coupled to one of the frame and the stator due to a force in which the hook portion and the extension portion are restored to a state in which the hook portion and the extension portion are originally found, before being modified by being coupled to the couple protrusion.

The pickup portion may have a shape of a spiral wing or plate.

The compressor may further include a bush member that is coupled to the outer circumferential surface of the rotation shaft between the rotor and the cap member so as to prevent the oil from leaking through a gap between the rotor and the cap member and that rotates together with the rotation shaft.

The bush member may include a body having a hollow portion or space into which the rotation shaft is inserted, and a flange that extends from an end of the body in the radial direction so as to closely contact the rotor.

The bush member may cover at least one part of the spiral groove.

The cap member may closely contact the rotor so that a gap through which the oil leaks is not formed between the rotor and the cap member.

In accordance with another aspect of the present invention, there is provided a compressor including: a sealing case having a lower portion in which oil is stored; a frame accommodated in the sealing case; a compression mechanism including a cylinder fixed to the frame and a piston that advances and retreats so as to compress a refrigerant of the cylinder; an electric motor-operated mechanism including a stator fixed to the frame and a rotor that rotates in the stator; a rotation shaft that is coupled to an inner side of the rotor and rotates together with the rotor, wherein at least one part of the rotation shaft is submerged in the oil stored in the sealing case and a spiral groove is formed in an outer circumferential surface of the rotation shaft so as to allow the oil to ascend; a cap member that accommodates the at least one part of the rotation shaft and that is fixed to one of the frame and the stator; and a bush member that is coupled to the outer circumferential surface of the rotation shaft between the rotor and the cap member so as to prevent the oil from leaking through a gap between the rotor and the cap member and that rotates together with the rotation shaft.

The rotation shaft may include a pickup portion that is submerged in the oil stored in the sealing case and has a spiral shape, and the pickup portion and the cap member may guide the oil stored in the sealing case to the spiral groove.

In accordance with another aspect of the present invention, there is provided a compressor including: a sealing case having a lower portion in which oil is stored; a frame accommodated in the sealing case; a compression mechanism including a cylinder fixed to the frame and a piston that advances and retreats so as to compress a refrigerant of the cylinder; an electric motor-operated mechanism including a stator fixed to the frame and a rotor that rotates in the stator; a rotation shaft that is coupled to an inner side of the rotor and rotates together with the rotor, wherein at least one part of the rotation shaft is submerged in the oil stored in the sealing case and a spiral groove is formed in an outer circumferential surface of the rotation shaft so as to allow the oil to ascend; and a cap member that accommodates the at least one part of the rotation shaft, is fixed to one of the frame and the stator, and closely contacts the rotor.

The rotation shaft may include a pickup portion that is submerged in the oil stored in the sealing case and has a spiral shape, and the pickup portion and the cap member may guide the oil stored in the sealing case to the spiral groove.

In accordance with another aspect of the present invention a compressor may include a sealing case, a frame disposed in the sealing case, a compression mechanism comprising a cylinder and a piston to compress a refrigerant of the cylinder, an electric motor-operated mechanism comprising a stator fixed to the frame and a rotor that rotates in the stator, a rotation shaft to rotate together with the rotor to drive a motion of the piston, having a groove formed only on an outer circumferential surface of the rotation shaft, and a cap member circumferentially surrounding at least a portion of the rotation shaft, and coupled to the stator. The compressor may further include a pickup portion extending from a bottom portion of the rotation shaft, and the cap member may circumferentially surround at least a portion of the pickup portion. The rotor and the rotation shaft may rotate together without rotating the cap member.

In accordance with another aspect of the present invention a refrigerating cycle device includes a compressor, the compressor including: a sealing case having a lower portion in which oil is to be stored; a frame disposed in the sealing case; a compression mechanism comprising a cylinder and a piston to compress a refrigerant of the cylinder; an electric motor-operated mechanism comprising a stator fixed to the frame and a rotor that rotates in the stator; a rotation shaft coupled to an inner side of the rotor that rotates together with the rotor, wherein a pickup portion is disposed in a lower portion of the rotation shaft and a groove is formed in an upper outer circumferential surface of the pickup portion; and a cap member to accommodate the pickup portion and is fixed to one of the frame and the stator.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
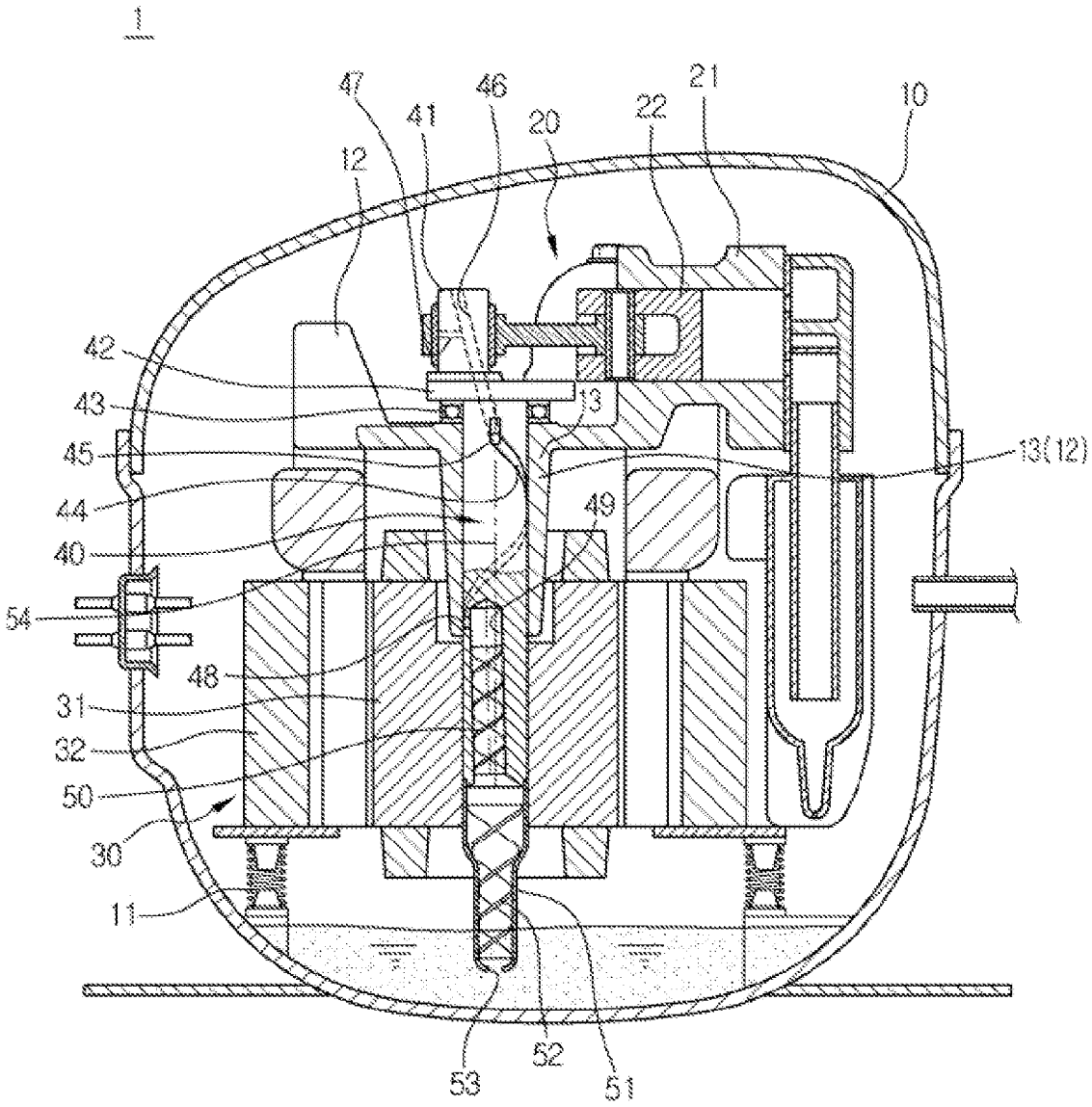
FIG. 1 is a schematic cross-sectional view of a compressor according to the related art.

Reference will now be made in detail to the embodiments of the present invention, examples of which are illustrated in the accompanying drawings, wherein like reference numerals refer to like elements throughout.

FIG. 1 is a schematic cross-sectional view of a compressor 1 according to the related art. Referring to FIG. 1, the compressor 1 according to the related art includes a sealing case 10, a frame 12 which is supported by a buffer unit 11 and to which elements of the sealing case 10 are fixed, a compression mechanism 20 that is installed above the frame 12, an electric motor-operated mechanism 30 that is installed below the frame 12 so as to drive the compression mechanism 20, and a rotation shaft 40 that is disposed in a vertical direction so as to transfer a driving force of the electric motor-operated mechanism 30 to the compression mechanism 20 and that is rotatably supported by a shaft support 13 of the frame 12.

The compression mechanism 20 includes a cylinder 21 that forms a compression space of a refrigerant and is fixed to the frame 12, and a piston 22 that advances and retreats in the cylinder 21 and compresses the refrigerant.

The electric motor-operated mechanism 30 includes a stator 32 fixed to the frame 12, and a rotor 31 that rotates in the stator 32. The rotor 31 includes a hollow portion in which the rotation shaft 40 may be accommodated, and the rotation shaft 40 is forcibly inserted into the hollow portion of the rotor 31, is coupled to the rotor 31, and rotates together with the rotor 31.

An eccentric portion 41 is formed on an upper portion of the rotation shaft 40 and is formed with its center of rotation positioned eccentric to a central axis 54 of the rotation shaft 40. The eccentric portion 41 is connected to the piston 22 by a connecting rod 23. Thus, a rotation motion of the rotation shaft 40 may be changed into a straight motion of the piston 22.

Also, a disc portion 42 may be formed at a lower side of the eccentric portion 41 and extend in a direction of a radius of the rotation shaft 40. A trust bearing 43 may be interposed between the disc portion 42 and the shaft support 13, may allow the rotation shaft 40 to smoothly rotate, and may support an axial load of the rotation shaft 40.

Oil for lubricating and cooling elements of the compressor 1 is stored in a lower portion of the sealing case 10. The oil ascends by the rotation shaft 40 and is supplied to each of the elements.

Here, a guide cap 51 and a first spiral wing 52 are disposed in a lower portion of the rotation shaft 40. The guide cap 51 is disposed to be submerged in the oil so as to pick up the oil stored in the sealing case 10, and the first spiral wing 52 is formed in the guide cap 51. An opening 53 through which the oil is introduced is formed in a lower portion of the guide cap 51. The guide cap 51 and the first spiral wing 52 rotate together with the rotation shaft 40 and guide the oil stored in the sealing case 10 to an internal path 49.

The internal path 49 is formed with its center of rotation positioned somewhat eccentric to the central axis 54 of the rotation shaft 40. Thus, the oil guided to the internal path 49 may ascend due to a centrifugal force when the rotation shaft 40 rotates. In this case, a second spiral wing 50 may be disposed on the internal path 49 so as to improve an ascending force of the oil.

Also, a spiral groove 44 is formed in an outer circumferential surface of an upper portion of the rotation shaft 40 and communicates with the internal path 49 through a first communication hole 48. Thus, the oil that ascends by the internal path 49 is guided to the spiral groove 44 formed in the outer circumferential surface of the rotation shaft 40 through the first communication hole 48, and the oil guided to the spiral groove 44 may ascend due to the centrifugal force by lubricating a space between the rotation shaft 40 and the shaft support 13 of the frame 12.

Also, a first supply path 46 and a second supply path 47 are formed in the upper portion of the rotation shaft 40 and communicate with the spiral groove 44 through a second communication hole 45. The oil may be supplied to an upper side of the eccentric portion 41 and the piston 22 through the first supply path 46 and the second supply path 47.

In this way, since an oil supply structure according to the related art uses both an inner side and an outer side of the rotation shaft 40, processing of the rotation shaft 40 is complicated. Also, since the guide cap 51 that guides the oil stored in the sealing case 10 to the internal path 49 of the rotation shaft 40 rotates together with the rotation shaft 40, vibration of an oil level is transferred to an outer side of the guide cap 51, and noise occurs.

Figure 2:
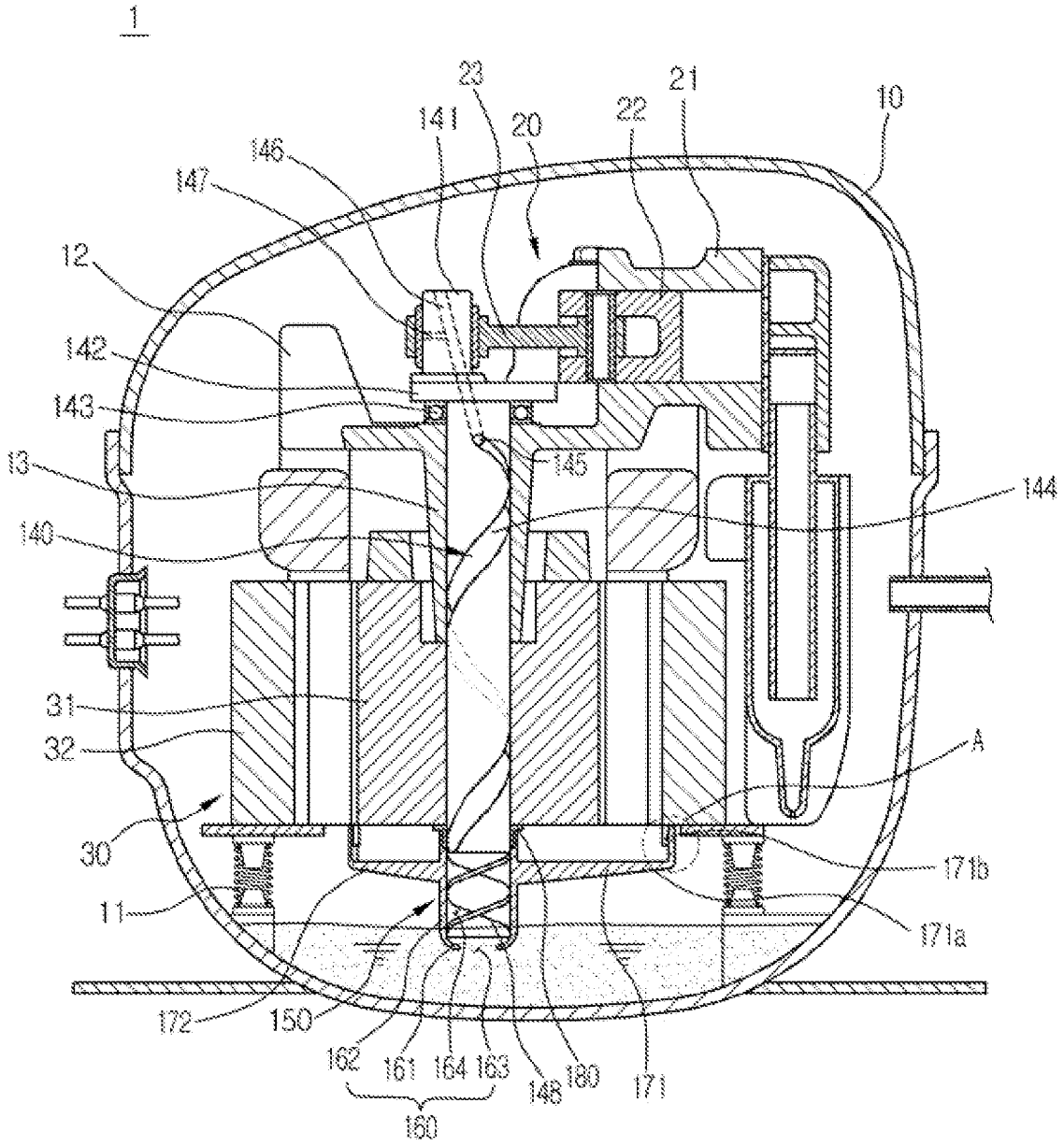
FIG. 2 is a schematic cross-sectional view of a compressor according to an embodiment of the present invention.
Figure 3:
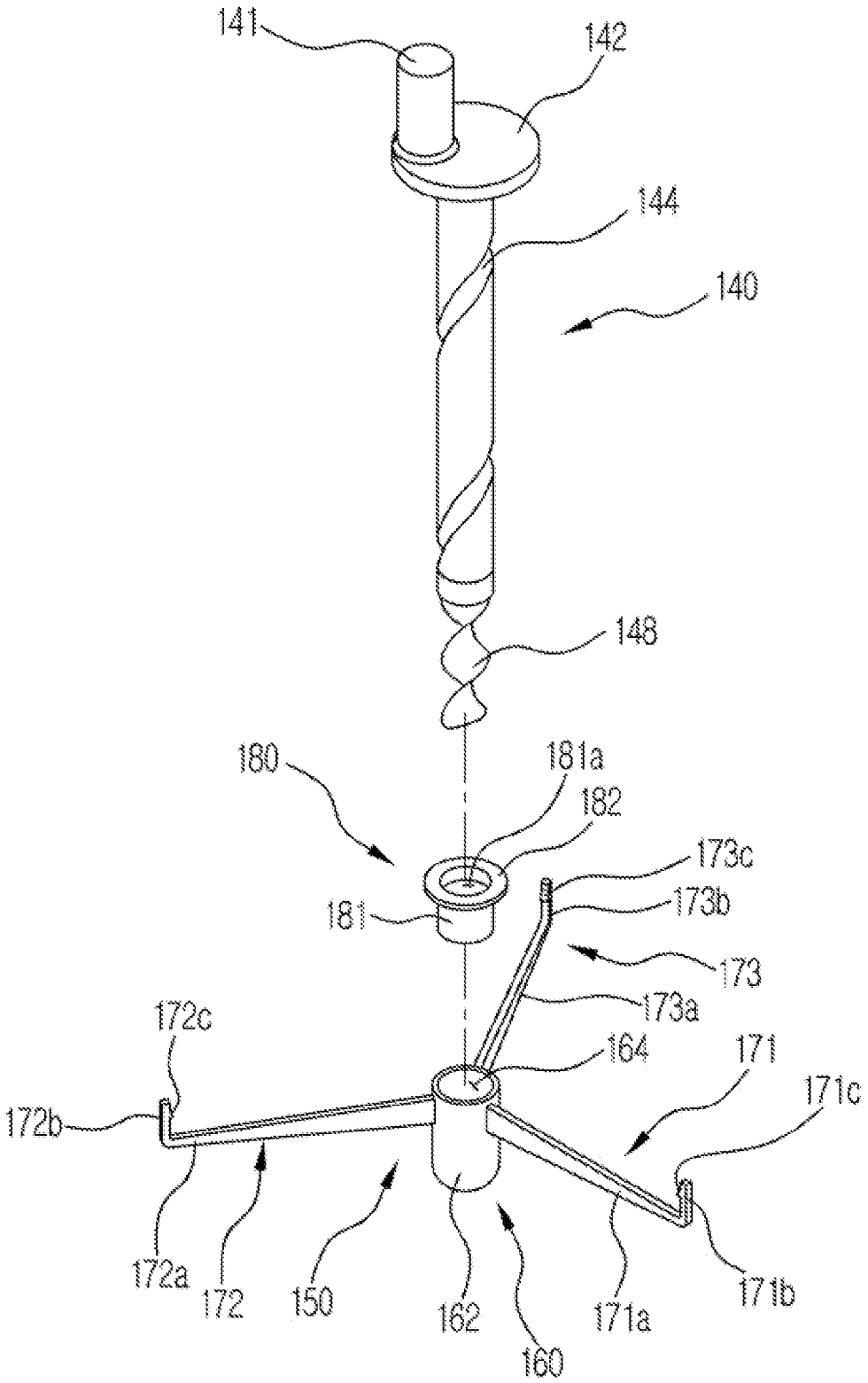
FIG. 3 is an exploded perspective view of a rotation shaft, a bush member, and a cap member of the compressor illustrated in FIG. 2.
Figure 4:
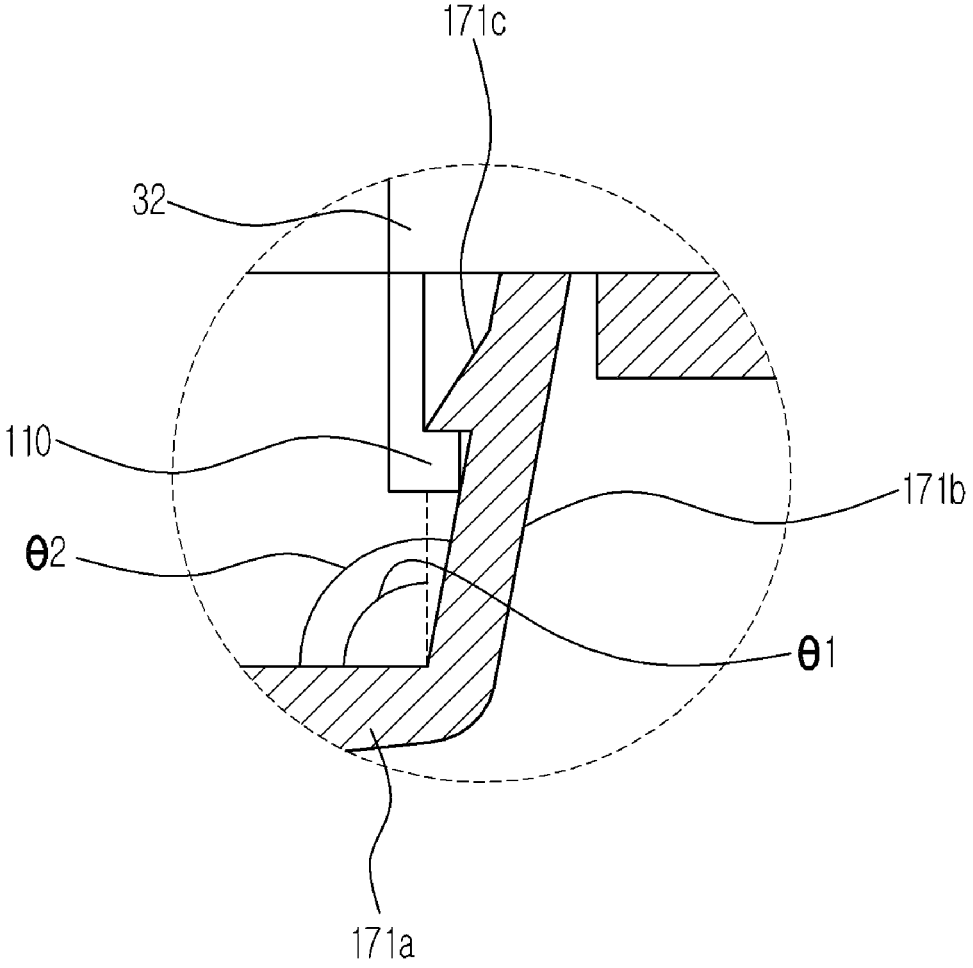
FIG. 4 is an enlarged view of an A-region of FIG. 2.
Figure 5:
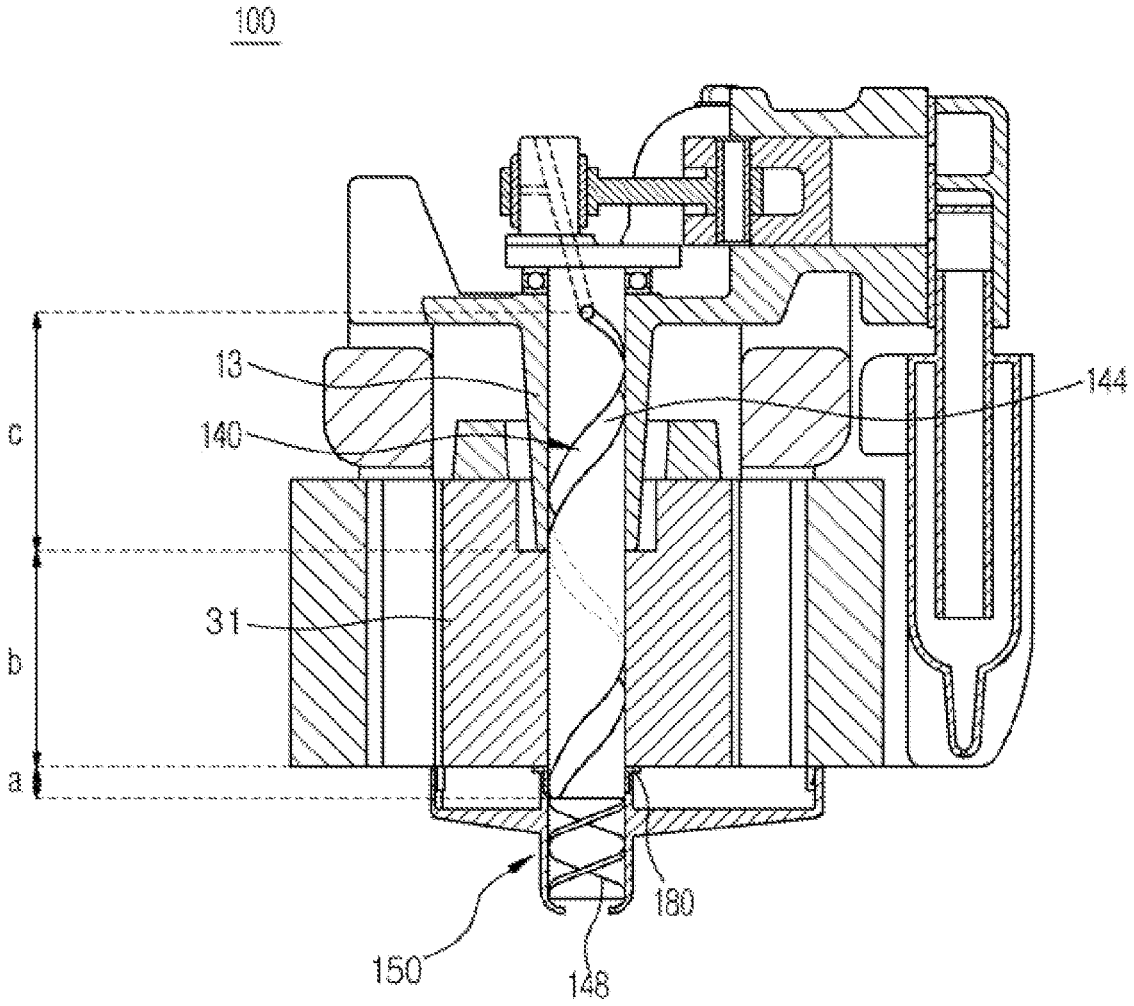
FIG. 5 is a view for explaining an oil supply structure of the compressor of FIG. 2.
Figure 6:
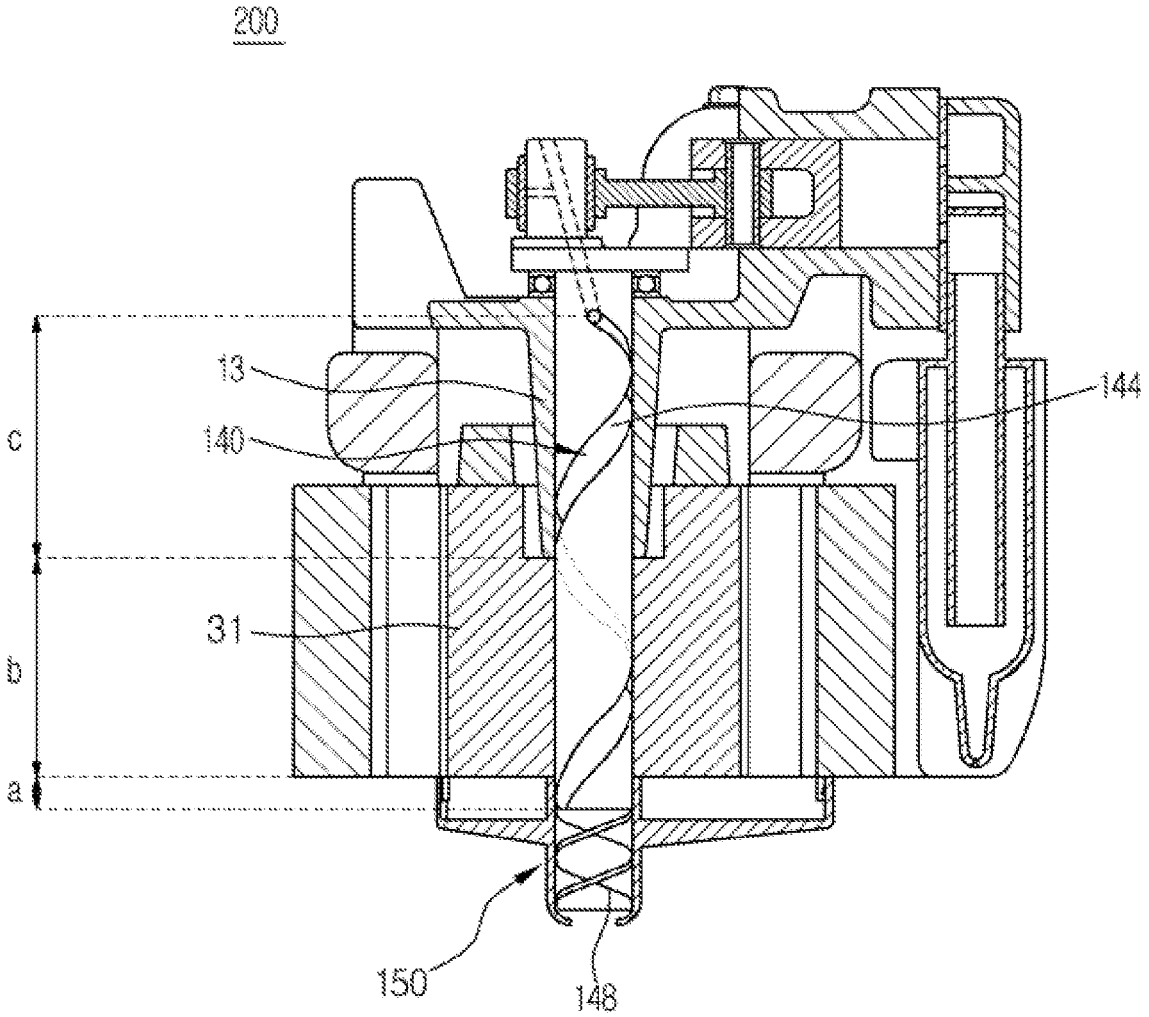
FIG. 6 is a view for explaining an oil supply structure of a compressor, according to another embodiment of the present invention.

FIG. 2 is a schematic cross-sectional view of a compressor 100 according to an embodiment of the present invention, FIG. 3 is an exploded perspective view of a rotation shaft, a bush member, and a cap member of the compressor 100 illustrated in FIG. 2, FIG. 4 is an enlarged view of a region A of FIG. 2, FIG. 5 is a view for explaining an oil supply structure of the compressor 100 of FIG. 2, and FIG. 6 is a view for explaining an oil supply structure of a compressor 200 according to another embodiment of the present invention.

Like reference numerals are used for like elements from FIG. 1, and the descriptions thereof may be omitted.

The compressor 100 according to the current embodiment of the present invention includes a rotation shaft 140 that is coupled to an inner side of a rotor 31, rotates together with the rotor 31 and transfers a driving force of an electric motor-operated mechanism 30 to a compression mechanism 20. The rotation shaft 140 may be forcibly inserted into a hollow space or portion of the rotor 31 and coupled to the rotor 31.

A pickup portion 148 may be disposed at a lower portion of the rotation shaft 140. A predetermined part of the pickup portion 148 may be submerged in oil which is stored in a lower portion of a sealing case 10, and a groove 144 (for example, a spiral groove) that allows the oil to ascend may be formed in an upper outer circumferential surface of the pickup portion 148.

The pickup portion 148 may have the shape of a spiral wing, as illustrated in FIGS. 2 through 6, and although not shown, the pickup portion 148 may be simply plate-shaped. The pickup portion 148 may be formed integrally with the rotation shaft 140 or may be formed independently of the rotation shaft 140 and thus may be coupled to the rotation shaft 140. As can be seen from FIG. 2 and FIG. 3, for example, the diameter of the pickup portion 148 may be substantially the same as the diameter of the rotation shaft 140.

The spiral groove 144 may be successively formed in an outer circumferential surface of the rotation shaft 140 starting from the top of the pickup portion 148 to a communication hole 145. Here, the top of the pickup portion 148 may refer to the upper portion of the pickup portion 148 which is adjacent to lower portion of the rotation shaft 140. As illustrated in FIG. 5, the spiral groove 144 may be covered (or circumferentially surrounded) by a cap member 150 or a bush member 180 that will be described below and may be disposed in a closed space in a section "a" which extends from the top of the pickup portion 148 to the bottom of the rotor 31, may be covered (or circumferentially surrounded) by the rotor 31 and may be disposed in a closed space in a section "b" which extends from the bottom of the rotor 31 to the top of the rotor 31, and may be covered (or circumferentially surrounded) by the shaft support 13 and may be disposed in a closed space in a section "c" which extends from the bottom of the shaft support 13 to the communication hole 145.

In this case, the top of the rotor 31 and the bottom of the shaft support 13 may closely contact each other so that oil may not leak from the sealing case 10.

Through this structure, the oil may ascend up to an upper portion of the rotation shaft 140 along the spiral groove 144 formed in the outer circumferential surface of the rotation shaft 140. The oil that ascends up to the communication hole 145 formed in the upper portion of the rotation shaft 140 may be supplied to the upper side of an eccentric portion 141 through a first supply path 146 or may be supplied to a piston 22 through a second supply path 147. The eccentric portion 141 may refer to a body which may be disposed on an upper surface of the disc portion 142, and may be disposed off-center from the central axis of the rotation shaft 140, as shown in FIG. 3, for example. A trust bearing 143 may be interposed between the disc portion 142 and the shaft support 13, may allow the rotation shaft 140 to smoothly rotate, and may support an axial load of the rotation shaft 140.

Thus, when the rotation shaft 140 rotates, the oil in the spiral groove 144 may not escape from the spiral groove 144 but may be transferred upward along the spiral groove 144.

The cap member 150 may be disposed at a lower portion of the rotation shaft 140 and guide the oil stored in the lower portion of the sealing case 10 to the spiral groove 144 together with the rotating pickup portion 148. The cap member 150 may accommodate a lower portion of the rotation shaft 140 including the pickup portion 148. Here, the cap member 150 (or portions of the cap member) may be fixed to a stator 32 and may not rotate together with the rotation shaft 140. However, although not shown, the cap member 150 may be fixed to a frame 12 in addition to the stator 32.

The cap member 150 includes an accommodation portion 160 having an internal space 164 in which the lower portion of the rotation shaft 140 including the pickup portion 148 may be accommodated, and leg portions 171, 172, and 173 that extend from the accommodation portion 160 in a radial direction so as to fix the cap member 150 to the frame 120 or the stator 32. As can be seen from FIG. 2, the accommodation portion 160 having the internal space 164 may have a diameter substantially similar to the diameter of the diameter of the diameter of the rotation shaft 140 and the pickup portion 148. The leg portions 171, 172, 173, may extend in a radially outward direction from the accommodation portion 160 at an upper portion of the accommodation portion 160.

A top surface of the internal space 164 of the accommodation portion 160 may be open so that the lower portion of the rotation shaft 140 can be accommodated in the internal space 164 of the accommodation portion 160. Also, the accommodation portion 160 may include a lower wall 161, and sidewalls 162 that extend from the lower wall 161 upward so as to form the internal space 164. In this case, an opening 163 may be formed in the lower wall 161 so that the oil may flow into the internal space 164 through the opening 163.

The cap member 150 of the compressor 100 illustrated in FIG. 2 has three leg portions 171, 172, and 173; however, aspects of the present invention are not limited thereto, and the cap member 150 may have two leg portions or four or more leg portions. In one embodiment, the three leg portions 171, 172, and 173 may have a common angle, for example, an angle of 120°. However, the leg portions need not be evenly separated such that they share a common angle.

In detail, the leg portions 171, 172, and 173 may include extension portions 171*a*, 172*a*, and 173*a* that extend from the sidewalls 162 of the accommodation portion 160 in the radial direction, and hook portions 171*b*, 172*b*, and 173*b* that extend upward from ends of the extension portions 171*a*, 172*a*, and 173*a*. Hanging protrusions 171*c*, 172*c*, and 173*c* may be formed on the hook portions 171*b*, 172*b*, and 173*b* so that each of the hanging protrusions 171*c*, 172*c*, and 173*c* can be hung on and coupled to a coupling protrusion 110 formed on the stator 32.

In this case, the leg portions 171, 172, and 173 may be modified in such a way that an angle between each of the extension portions 171*a*, 172*a*, and 173*a* and each of the hook portions 171*b*, 172*b*, and 173*b* may increase when each of the hanging protrusions 171*c*, 172*c*, and 173*c* is coupled to the coupling protrusion 110 of the stator 32. Also, the leg portions 171, 172, and 173 may be formed of an elastic material in such a way that each of the leg portions 171, 172, and 173 may be firmly coupled to the stator 32 due to a force in which each of the extension portions 171*a*, 172*a*, and 173*a* and each of the hook portions 171*b*, 172*b*, and 173*b* is restored to a state before modification.

That is, as illustrated in FIG. 4, assuming that an angle between each of the extension portions 171*a*, 172*a*, and 173*a* and each of the hook portions 171*b*, 172*b*, and 173*b* is θ1 before each of the hanging protrusions 171*c*, 172*c*, and 173*c* of the leg portions 171, 172, and 173 is coupled to the coupling protrusion 110 of the stator 32, if each of the hanging protrusions 171*c*, 172*c*, and 173*c* of the leg portions 171, 172, and 173 is coupled to the coupling protrusion 110 of the stator 32, the angle between each of the extension portions 171*a*, 172*a*, and 173*a* and each of the hook portions 171*b*, 172*b*, and 173*b* may be increased to θ2.

In this case, each of the hook portions 171*b*, 172*b*, and 173*b* has a restoring force in a direction in which the angle between each of the extension portions 171*a*, 172*a*, and 173*a* and each of the hook portions 171*b*, 172*b*, and 173*b* is again reduced to θ1. That is, the restoring force of the elastic material of the hook portions causes the hook portions to return to the original angle θ1, after the hook portions are temporarily being deformed in order to be coupled to the coupling protrusion 110. Thus, since each of the hook portions 171*b*, 172*b*, and 173*b* may closely contact the stator 32 due to the restoring force, each of the leg portions 171, 172, and 173 may be firmly coupled to the stator 32.

As described above, since the cap member 150 (or a portion of the cap member 150) is fixed to the stator 32 or the frame 12 and does not rotate together with the rotation shaft 140, the movement of the oil may occur in the internal space 164 of the cap member 150 when the rotation shaft 140 rotates. The movement of the oil that occurs in the internal space 164 of the cap member 150 may be prevented from being transferred to the outer side of the cap member 150 due to the sidewalls 162 of the cap member 150. For example, as shown in FIG. 2, a portion of the sidewalls 162 including the lower walls 161 may be submerged in the oil, and at least a portion of the lower walls 161 may be curved near the opening of opening 163 at a bottom portion of the cap member 150. As stated above, unlike conventional compressors, in the present invention the cap member does not rotate together with the rotation shaft 140 and movement of the oil when the rotation shaft 140 rotates is limited to the internal space 164 of the cap member 150. Thus, noise caused by the movement of the oil can be reduced.

Due to an error in manufacturing or assembling the cap member 150, a gap between where the cap member 150 and the rotor 31 are connected or contact with one another, may be formed. Also, the oil in the spiral groove 144 may leak through the gap between the cap member 150 and the rotor 31.

Thus, the compressor 100 of FIG. 2 may further include the bush member 180 that is coupled to the outer circumferential surface of the rotation shaft 140 between the cap member 150 and the rotor 31 so as to prevent the oil from leaking through the gap between the cap member 150 and the rotor 31.

The bush member 180 may include a body 181 having a hollow space or portion 181*a* in which the rotation shaft 140 is inserted, and a flange 182 that extends from the top of the body 181 in the outward radial direction. The flange 182 may closely contact the rotor 31 to prevent leakage of oil. The rotation shaft 140 may be forcibly inserted into the bush member 180 and coupled to the bush member 180. Thus, the bush member 180 may rotate together with the rotation shaft 140. Through this structure, the spiral groove 144 between the cap member 150 and the rotor 31 may be covered (or circumferentially surrounded) by the bush member 180 and may be disposed in a closed space.

However, the cap member 150 may closely contact the rotor 31, and the bush member 180 may be omitted. In this case, as illustrated in FIG. 6, the spiral groove 144 may be covered (or circumferentially surrounded) by only the cap member 150 and may be disposed in a closed space in the section "a" extending from the top of the pickup portion 148 to the bottom of the rotor 31.

As described above, an inner side of a rotation shaft according to the spirit of the present invention need not be processed, and only an outer circumferential surface of the rotation shaft is processed so that processing of the rotation shaft is simplified compared to a rotation shaft according to the related art. That is, a groove (for example a spiral groove) is only formed on an outer circumferential surface of the rotation shaft 140, and not on inner surface of the rotation shaft 140.

In addition, since an oil supply structure that allows oil to ascend uses a spiral groove formed in the outer circumferential surface of the rotation shaft, the speed at which the oil ascends increases. As can be seen from FIG. 2, oil may be stored in a lower portion of the sealing case 10, for example in an oil pan. The oil in the lower portion of the sealing case 10 may be filled to a predetermined level. For example, the oil may be filled to a level below the leg portions, below the buffer unit 11, and more particularly to a level that is between the bottom portion of the buffer unit 11 and lower wall 161.

In addition, a diameter of the rotation shaft according to the related art is limited to a predetermined size so as to perform processing of the inner side of the rotation shaft. However, since the rotation shaft according to the present invention does not require inner side processing, its diameter size is not limited.

Furthermore, according to the spirit of the present invention, since a cap member for accommodating a lower portion of the rotation shaft is fixed to a frame and/or a stator, vibration of an oil level caused by rotation of the rotation shaft is prevented from being transferred to the outer side of the cap member.

The compressor disclosed in accordance with the above-described embodiments may be utilized in a refrigerating cycle device, for example, for air conditioning, heat pump, and refrigeration applications. The compressor according to the above-described embodiments may be embodied as a hermetic compressor, in which the compressor and the motor driving the compressor are integrated, and operate within a sealed case, as shown in FIG. 2, for example.

Although a few example embodiments of the present invention have been shown and described, it would be appreciated by those skilled in the art that changes may be made to these embodiments without departing from the principles and spirit of the invention, the scope of which is defined in the claims and their equivalents.

What is claimed is:

1. A compressor, comprising:

a sealing case having a lower portion in which oil is to be stored;

a frame disposed in the sealing case;

a compression mechanism comprising a cylinder and a piston to compress a refrigerant of the cylinder;

an electric motor-operated mechanism comprising a stator fixed to the frame and a rotor that rotates in the stator;

a rotation shaft coupled to an inner side of the rotor that rotates together with the rotor, wherein a pickup portion is disposed in a lower portion of the rotation shaft; and a cap member to accommodate the pickup portion and configured to guide the oil to be stored in the lower portion of the sealing case to the rotation shaft, wherein the cap member is disposed at a lower portion of the rotation shaft such that the cap member closely contacts the rotor to prevent a gap from being formed between the rotor and the cap member, and the cap member includes at least one leg portion fixed to at least one of the frame and the stator so that the rotation shaft is rotatable without rotating the cap member.

2. The compressor according to claim 1, wherein the cap member comprises an accommodation portion having an internal space, of which a top surface is open, so as to accommodate the pickup portion, and the at least one leg portion extends from the accommodation portion in a radial direction and is fixed to the at least one of the frame and the stator.

3. The compressor according to claim 2, wherein the accommodation portion comprises a lower wall, and sidewalls that extend from the lower wall upward to form the internal space.

4. The compressor according to claim 3, wherein an opening is formed in the lower wall.

5. The compressor according to claim 3, wherein, when oil is stored in the lower portion of the sealing case, vibration of an oil level caused by rotation of the rotation shaft is prevented by the sidewalls of the cap member and is not transferred to an outer side of the cap member.

6. The compressor according to claim 2, wherein the at least one leg portion comprises an extension portion that extends from the accommodation portion in the radial direction, a hook portion that extends from an end of the extension portion upward, and a hanging protrusion formed on the hook portion, and at least one coupling protrusion corresponding to the hanging protrusion is formed on at least one of the frame and the stator.

7. The compressor according to claim 6, wherein the at least one leg portion is formed of an elastic material, an angle between the hook portion and the extension portion increases when the hanging protrusion is coupled to the coupling protrusion, and the angle between the hook portion and the extension portion decreases and is restored to a state before the hook portion and the extension portion were coupled to the coupling protrusion.

8. The compressor according to claim 1, wherein the pickup portion has a spiral screw shape or a flat shape.

9. The compressor according to claim 1, further comprising a bush member coupled to the outer circumferential surface of the rotation shaft, disposed between the rotor and the cap member and rotatable together with the rotation shaft.

10. The compressor according to claim 9, wherein the bush member comprises a body having a hollow portion into which the rotation shaft is inserted, and a flange that extends from an end of the body in the radial direction to closely contact the rotor.

11. The compressor according to claim 9, wherein a groove is formed in an upper outer circumferential surface of the pickup portion, and the bush member covers at least one part of the groove.

12. The compressor according to claim 1, wherein a groove is formed in an upper outer circumferential surface of the pickup portion, and the cap member covers at least one part of the groove.

13. A compressor, comprising:

a sealing case having a lower portion in which oil is to be stored;

a frame disposed in the sealing case;

a compression mechanism comprising a cylinder and a piston to compress a refrigerant of the cylinder;

an electric motor-operated mechanism comprising a stator fixed to the frame and a rotor that rotates in the stator;

a rotation shaft coupled to an inner side of the rotor that rotates together with the rotor, wherein at least one part of the rotation shaft extends into the lower portion of the sealing case in which the oil is to be stored, and a groove is formed in an outer circumferential surface of the rotation shaft;

a cap member to accommodate the at least one part of the rotation shaft and configured to guide the oil to be stored in the lower portion of the sealing case to the groove; and a bush member that is coupled to the outer circumferential surface of the rotation shaft between the rotor and the cap member to prevent a gap from being formed between the rotor and the cap member and that rotates together with the rotation shaft, wherein the cap member is disposed at a lower portion of the rotation shaft and includes at least one leg portion fixed to at least one of the frame and the stator and comprises an accommodation portion having an internal space, of which a top surface is open, and a lower body portion of the bush member is inserted through the top surface of the internal space.

14. The compressor according to claim 13, further comprising a pickup portion which extends into the lower portion of the sealing case in which the oil is to be stored, and the rotation shaft has a spiral shape, and when oil is stored in the sealing case, the pickup portion and the cap member guide the oil to the groove.

15. A compressor, comprising:

a sealing case having a lower portion in which oil is stored;

a frame accommodated in the sealing case;

a compression mechanism and a piston that to compress a refrigerant of a cylinder of the compression mechanism;

an electric motor-operated mechanism comprising a stator fixed to the frame and a rotor that rotates in the stator;

a rotation shaft coupled to an inner side of the rotor that rotates together with the rotor, wherein at least one part of the rotation shaft is submerged in the oil stored in the sealing case and a groove is formed in an outer circumferential surface of the rotation shaft to allow the oil to ascend; and a cap member to accommodate the at least one part of the rotation shaft and to guide the oil stored in the lower portion of the sealing case to the groove, wherein the cap member is disposed at a lower portion of the rotation shaft, closely contacts the rotor, and includes at least one leg portion fixed to at least one of the frame and the stator so that the rotation shaft is rotatable without rotating the cap member.

16. The compressor according to claim 15, wherein the rotation shaft comprises a pickup portion that is submerged in the oil stored in the sealing case and has a spiral shape, and the pickup portion and the cap member guide the oil stored in the lower portion of the sealing case to the groove.

17. A compressor, comprising:

a sealing case;

a frame disposed in the sealing case;

a compression mechanism comprising a cylinder and a piston to compress a refrigerant of the cylinder;

an electric motor-operated mechanism comprising a stator fixed to the frame and a rotor that rotates in the stator;

a rotation shaft to rotate together with the rotor to drive a motion of the piston, having a groove formed on an outer circumferential surface of the rotation shaft; and a cap member configured to guide oil stored in the sealing case to the groove and disposed at a lower portion of the rotation shaft, circumferentially surrounding at least a portion of the rotation shaft, the cap member including:

a lower wall, side walls extending upward from the lower wall so as to form an internal space within the cap member surrounding at least the portion of the rotation shaft, and at least one leg portion extending radially outward from at least one of the side walls and coupled to the stator.

18. The compressor according to claim 17, further comprising a pickup portion extending from a bottom portion of the rotation shaft, wherein the cap member circumferentially surrounds at least a portion of the pickup portion.

19. The compressor according to claim 17, wherein the rotor and the rotation shaft rotate together without rotating the cap member.

20. A refrigerating cycle device, comprising:

a compressor, the compressor comprising:

a sealing case having a lower portion in which oil is to be stored;

a frame disposed in the sealing case;

a compression mechanism comprising a cylinder and a piston to compress a refrigerant of the cylinder;

an electric motor-operated mechanism comprising a stator fixed to the frame and a rotor that rotates in the stator;

a rotation shaft coupled to an inner side of the rotor that rotates together with the rotor;

a pickup portion disposed in a lower portion of the rotation shaft; and a cap member disposed at a lower portion of the rotation shaft to accommodate the pickup portion and configured to guide the oil to be stored in the lower portion of the sealing case to the rotation shaft, the cap member including:

a lower wall, side walls extending upward from the lower wall so as to form an internal space within the cap member surrounding at least a portion of the pickup portion, and at least one leg portion extending radially outward from at least one of the side walls and fixed to at least one of the frame and the stator so that the rotation shaft is rotatable without rotating the cap member.

21. The refrigerating cycle device according to claim 20, wherein the at least one leg portion is formed of an elastic material.

* * * * *